US008562369B2

(12) United States Patent
Wu

(10) Patent No.: US 8,562,369 B2
(45) Date of Patent: Oct. 22, 2013

(54) CABLE ASSEMBLY WITH A NEW INTERFACE

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 88 days.

(21) Appl. No.: 13/212,200

(22) Filed: Aug. 18, 2011

(65) Prior Publication Data

US 2012/0045920 A1 Feb. 23, 2012

(30) Foreign Application Priority Data

Aug. 18, 2010 (CN) ..... 2010 2 0296125

(51) Int. Cl.
*H01R 4/50* (2006.01)

(52) U.S. Cl.
USPC ..... 439/345; 439/352; 439/76.1

(58) Field of Classification Search
USPC ..... 439/345, 352, 353, 76.1
See application file for complete search history.

(56) References Cited

U.S. PATENT DOCUMENTS

| | | | | |
|---|---|---|---|---|
| 2,932,810 | A * | 4/1960 | Novak | 439/61 |
| 3,740,698 | A * | 6/1973 | Jerominek | 439/61 |
| 6,663,415 | B1 | 12/2003 | Wu | |
| 6,776,658 | B2 * | 8/2004 | Tang | 439/607.58 |
| 7,134,914 | B1 * | 11/2006 | Wu | 439/607.41 |
| 7,160,135 | B1 * | 1/2007 | Wu | 439/352 |
| 7,281,937 | B2 * | 10/2007 | Reed et al. | 439/352 |
| 7,354,292 | B1 * | 4/2008 | Lloyd et al. | 439/352 |
| 7,462,065 | B1 * | 12/2008 | Zhao | 439/499 |
| 7,540,785 | B1 * | 6/2009 | Zhao | 439/660 |
| 7,581,978 | B1 * | 9/2009 | Briant | 439/358 |
| 7,654,831 | B1 * | 2/2010 | Wu | 439/76.1 |
| 7,666,023 | B2 * | 2/2010 | Wu | 439/352 |
| 7,803,010 | B1 * | 9/2010 | Hwang | 439/497 |
| 7,841,887 | B2 * | 11/2010 | Zhang et al. | 439/352 |
| 7,896,689 | B1 * | 3/2011 | Su et al. | 439/497 |
| 7,901,238 | B1 * | 3/2011 | Muir et al. | 439/417 |
| 8,070,517 | B2 * | 12/2011 | Xiong et al. | 439/607.28 |
| 8,152,555 | B2 * | 4/2012 | Wu | 439/352 |
| 8,157,579 | B2 * | 4/2012 | Wu | 439/352 |
| 8,157,580 | B2 * | 4/2012 | Wu | 439/352 |
| 8,251,735 | B2 * | 8/2012 | Wu | 439/353 |
| 8,267,713 | B2 * | 9/2012 | Wu | 439/352 |
| 8,303,314 | B2 * | 11/2012 | Wu | 439/76.1 |
| 2010/0203754 | A1 * | 8/2010 | Li et al. | 439/345 |
| 2011/0059645 | A1 * | 3/2011 | Wu | 439/460 |
| 2011/0065328 | A1 * | 3/2011 | Wu | 439/660 |
| 2011/0183535 | A1 * | 7/2011 | Wu | 439/153 |
| 2011/0212643 | A1 * | 9/2011 | Reed et al. | 439/345 |
| 2011/0223809 | A1 * | 9/2011 | Reed et al. | 439/626 |
| 2011/0281455 | A1 * | 11/2011 | Wu | 439/345 |
| 2012/0045920 | A1 * | 2/2012 | Wu | 439/345 |
| 2012/0064750 | A1 * | 3/2012 | Wu | 439/345 |

* cited by examiner

*Primary Examiner* — Amy Cohen Johnson
*Assistant Examiner* — Vladimir Imas
(74) *Attorney, Agent, or Firm* — Wei Te Chung; Ming Chieh Chang

(57) ABSTRACT

A cable assembly (100), comprises: a metallic case (1) having a receiving room; a terminal module (2) disposed in the receiving room; a plurality of metallic clips (9) assembled to a front end of the terminal module; and a cable (8) extended into the receiving room and electrically connected with the terminal module.

19 Claims, 8 Drawing Sheets

CABLE ASSEMBLY WITH A NEW INTERFACE

FIELD OF THE INVENTION

The present invention relates to a cable assembly, and more particularly to a high speed cable assembly with a new interface for mating with a complementary connector.

DESCRIPTION OF PRIOR ART

US Patent Publication No. 20090253292 discloses a cable assembly. Please referring to FIGS. 1 to 6 of the above said patent, the cable assembly comprises a metallic housing, a pair of PCBs disposed in the housing and a plurality of cables electrically connected with the pair of PCBs, the pair of PCBs are arranged paralleled with each other in a vertical direction. The cable assembly further has a latching member and a pulling member assembled on a top surface of the metallic housing, the latching member is connected with the pulling member and actuated by the pulling member.

However, the height of a mating interface of the cable assembly will be increased due to the setting of the pair of PCBs. Thus, the interface of the cable assembly can not meet the developing trend of low profile. On another aspect, the signal transmitting speed of the cable assembly is required more and more quickly, thus, the conductive pads of the printed circuit board will also be increased. However, when the width of the PCB is determined, the more conductive pads should be formed on the PCB, so the layout of the printed circuit board will be more difficulty to design.

As discussed above, an improved cable assembly overcoming the shortages of existing technology is needed.

SUMMARY OF THE INVENTION

Accordingly, an object of the present invention is to provide a cable assembly with a lower profile mating face.

In order to achieve the above-mentioned objects, a cable assembly, comprises: a metallic case having a receiving room; a terminal module disposed in the receiving room; a plurality of metallic clips assembled to a front end of the terminal module; and a cable extended into the receiving room and electrically connected with the terminal module.

Other objects, features and advantages of the invention will be apparent from the following detailed description taken in connection with the accompanying drawings.

DETAILED DESCRIPTION OF PREFERRED EMBODIMENTS

Figure 1:
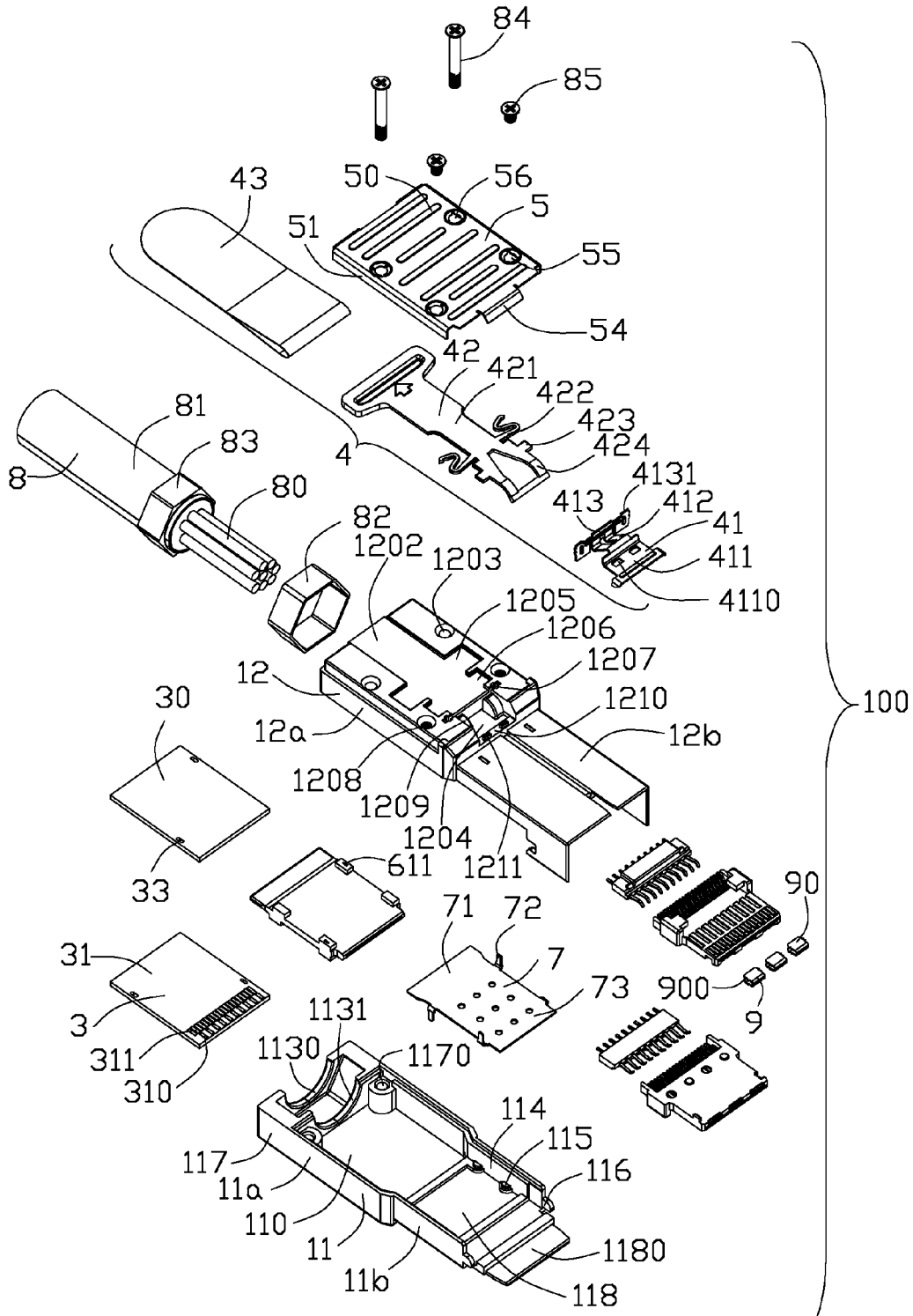
FIG. 1 is an exploded, perspective view of a cable assembly in accordance with the present invention.

Reference will now be made to the drawing figures to describe the present invention in detail.

Figure 2:
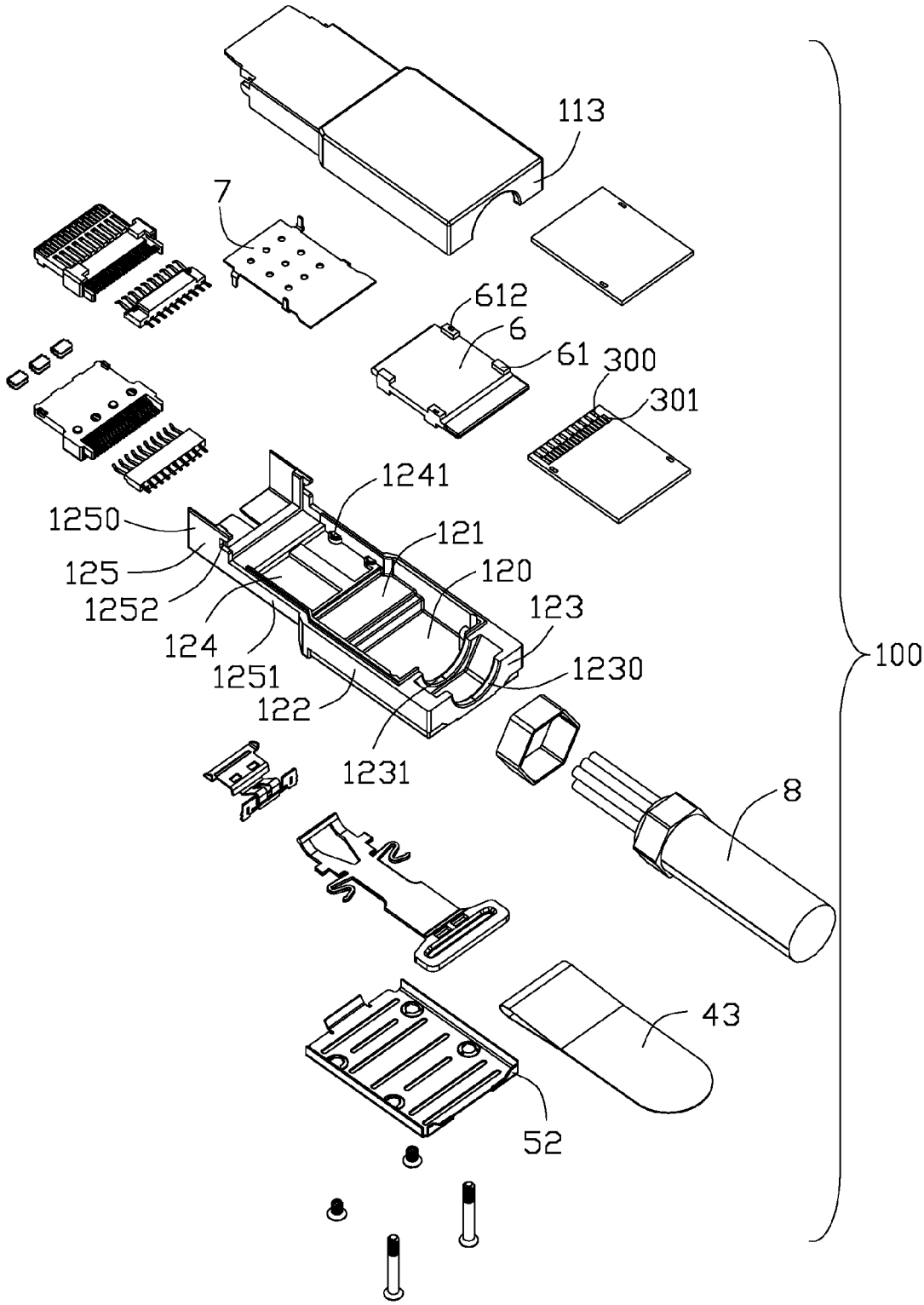
FIG. 2 is another exploded, perspective view of the cable assembly of FIG. 1.
Figure 3:
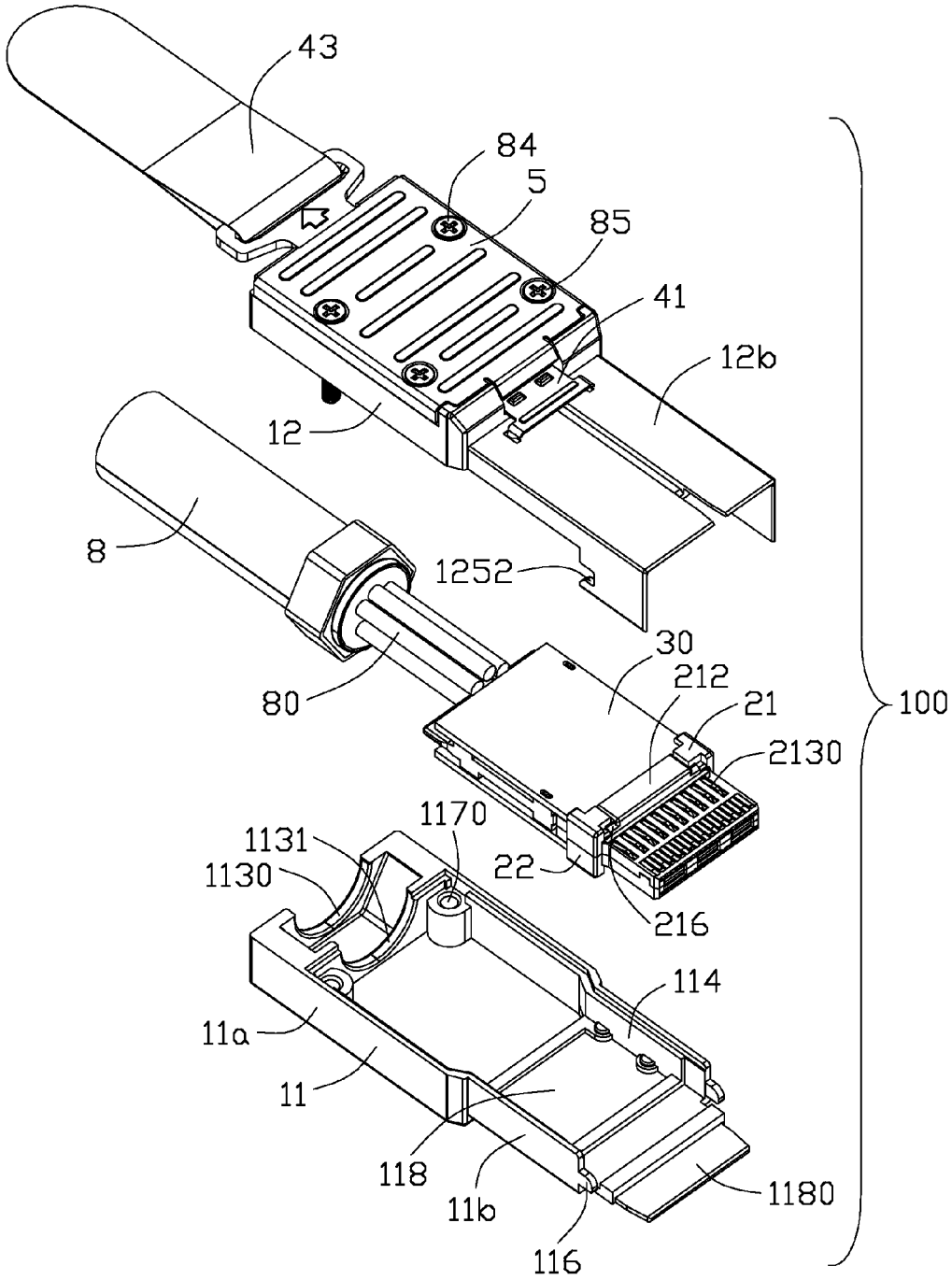
FIG. 3 is a partial exploded, perspective view of the cable assembly of FIG. 1.
Figure 4:
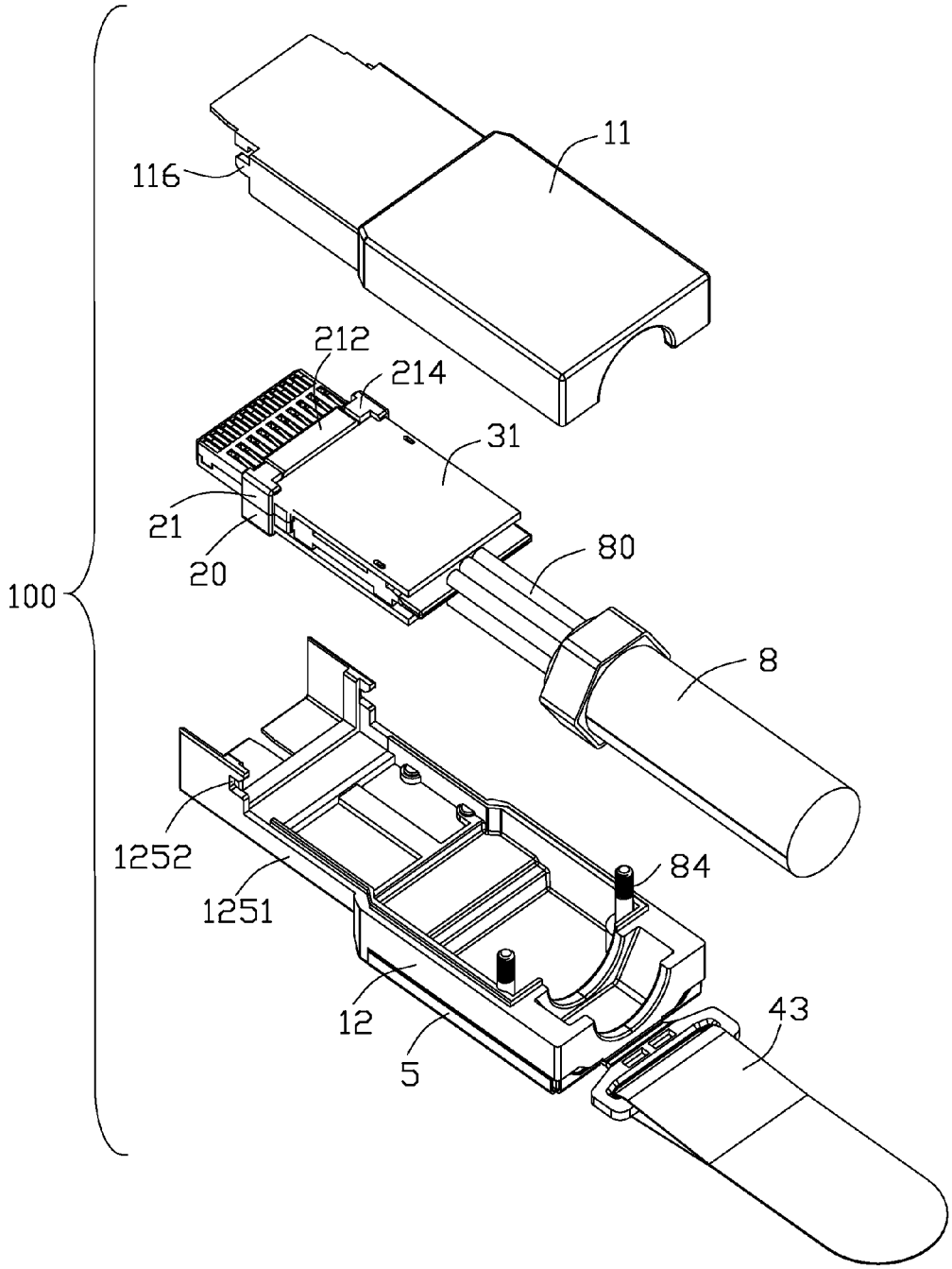
FIG. 4 is a partial exploded, perspective view of the cable assembly of FIG. 2.
Figure 5:
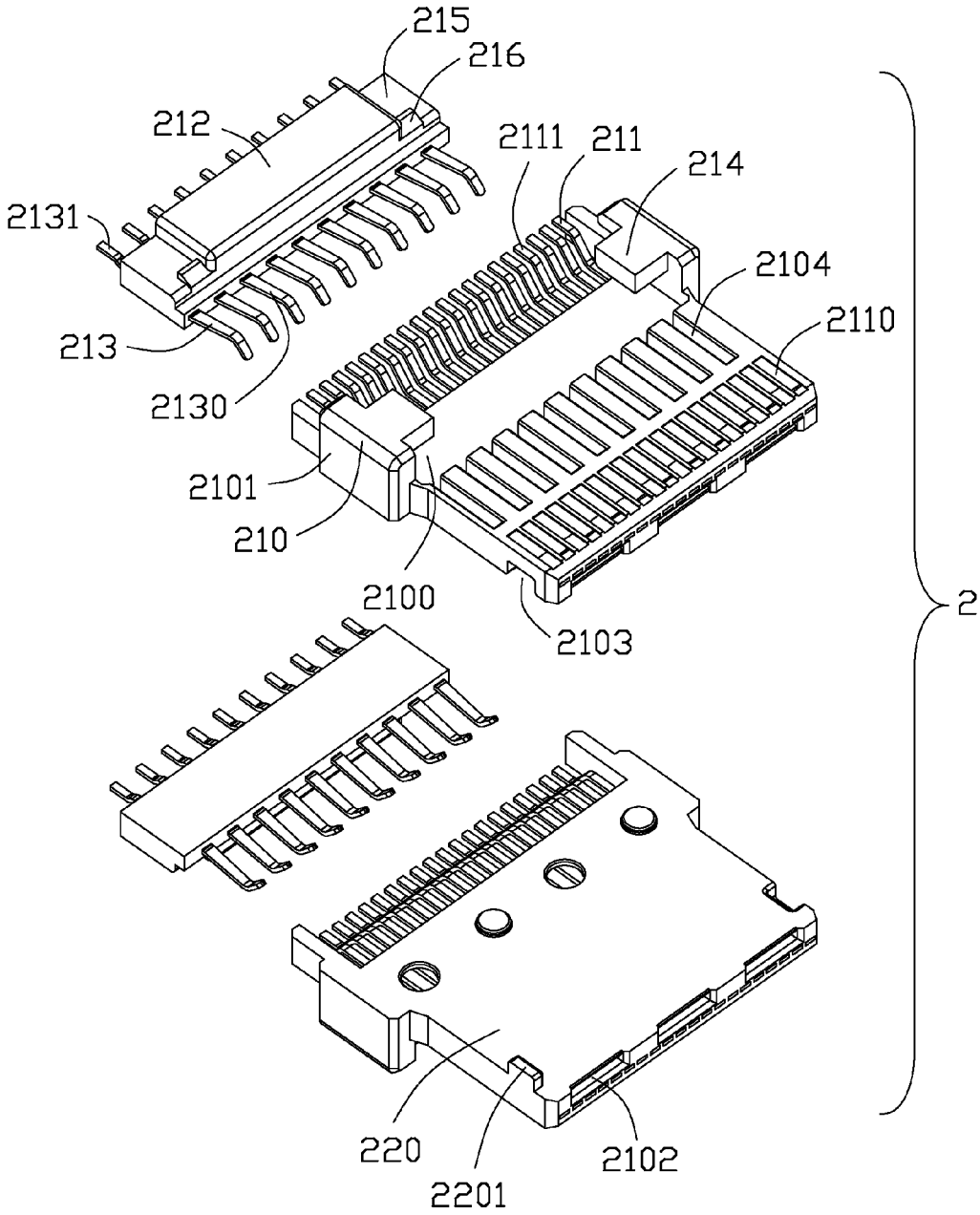
FIG. 5 is an exploded, perspective view of a terminal module shown in FIG. 1.
Figure 6:
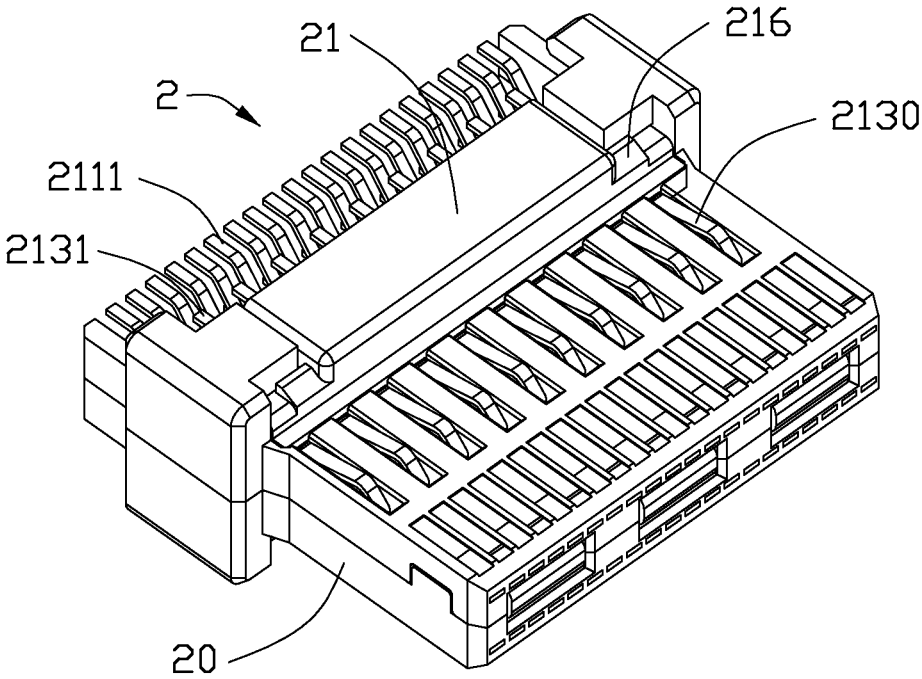
FIG. 6 is a perspective view of an assembled terminal module of the cable assembly shown in FIG. 3.

Please refer to FIGS. 1 to 2, a cable assembly 100 made in accordance with the present invention comprises a case 1, a pair of printed circuit boards 3 received into the case 1, a terminal module 2 electrically connected to two front ends of the pair of printed circuit boards 3, a cable 8 extended into the case 2 and electrically connected with two rear ends of the pair of printed circuit boards 3. The cable assembly 100 further comprises a latch mechanism 4 assembled to an exterior surface of the case 1 and a metallic shell 5 shielding a portion of the latch mechanism 4.

Referring to FIGS. 1 to 2, the case 1 is made of metallic material and formed by a first shield part 11 and a second shield part 12 assembled with each other. The case 1 defines a receiving room 15 formed therein and extending from a front surface (not figured) to the rear surface (not figured) thereof. The case 1 defines a body portion and a mating portion extending forwardly from the body portion.

Referring to FIGS. 1 to 2, the first shield part 11 defines a first base section 11*a* and a first mating section 11*b*. The first base section 11*a* defines a first bottom wall 110, a pair of first side walls 117 extending upwardly form two lateral sides of the first bottom wall 110 and a first rear wall 113 extending upwardly form a rear side of the first bottom wall 110. The first rear wall 113 defines two semi-circular cutouts 1130, 1131 extending along a front to rear direction and paralleled with each other. The first shield part 11 further defines two positioning holes 1170 respectively formed on two corners of the first wall 113 and the two side walls 117. The first mating section 11*b* defines a bottom wall 118 and two side walls 114 extending upwardly from two lateral sides of the bottom wall 118. Each of the side wall 114 defines a projection 116 extending forwardly from a front end thereof. The bottom wall 118 defines a flange 1180 formed at a front end thereof and a plurality of supporting pieces 115 formed on a top surface thereof. The plurality of supporting pieces 115 are arranged two rows and respectively disposed adjacent to the two side walls 114.

The second shield part 12 defines a second base section 12*a* and a second mating section 12*b* extending forwardly from the second base section 12*a*. The second base section 12*a* defines a top wall 120, a pair of side walls 122 extending downwardly from two lateral sides of the top wall 120 and a rear wall 123 extending downwardly form a rear side of the top wall 120. The rear wall 123 defines two semi-circular cutouts 1230, 1231 extending along a front to rear direction and paralleled with each other. The top wall 120 of the second shield part 12 defines a first channel 1202 formed on a top surface thereof and a second channel 1204 disposed in front end of the first channel 1202 and communicated with the first channel 1202. The second channel 1204 is located below the first channel 1202. A pair of first and second grooves 1205, 1206 are disposed at two sides of the first channel 1202 and communicated with the first channel 1202. The pair of second grooves 1206 are located in front of the pair of first grooves 1205. A pair of slits 1207 are disposed in back of the second channel 1204 and communicated with the second channel 1204. A pair of first screw holes 1203 are formed in the top wall 120 and throughout the top wall 120 along a vertical direction. A pair of supporting portions 1209 are formed at two inner sides of the second channel 1204. A platform 1210 is formed in a front end of the second channel 1204 and defines a pair of protrusions 1211 formed on a top surface thereof. The top wall 120 of the second shield part 12 defines step-like portion 121 formed on a bottom surface thereof. A pair of second screw receiving holes 1208 are formed in the top wall 120 and disposed at two sides of the second grooves 1206. The second mating section 12*b* defines a top wall 124 and a pair of L-shaped side walls 125 extending downwardly from two lateral side of the top wall 124. Each of the side wall 125 defines a front wide section 1250 and a rear narrow section 1251. The front wide section 1250 defines a gap 1252 for receiving the projection 116 of the first shield part 11. The top wall 124 defines a plurality of supporting pieces 1241 formed on a bottom surface thereof and arranged to two rows.

Figure 8:
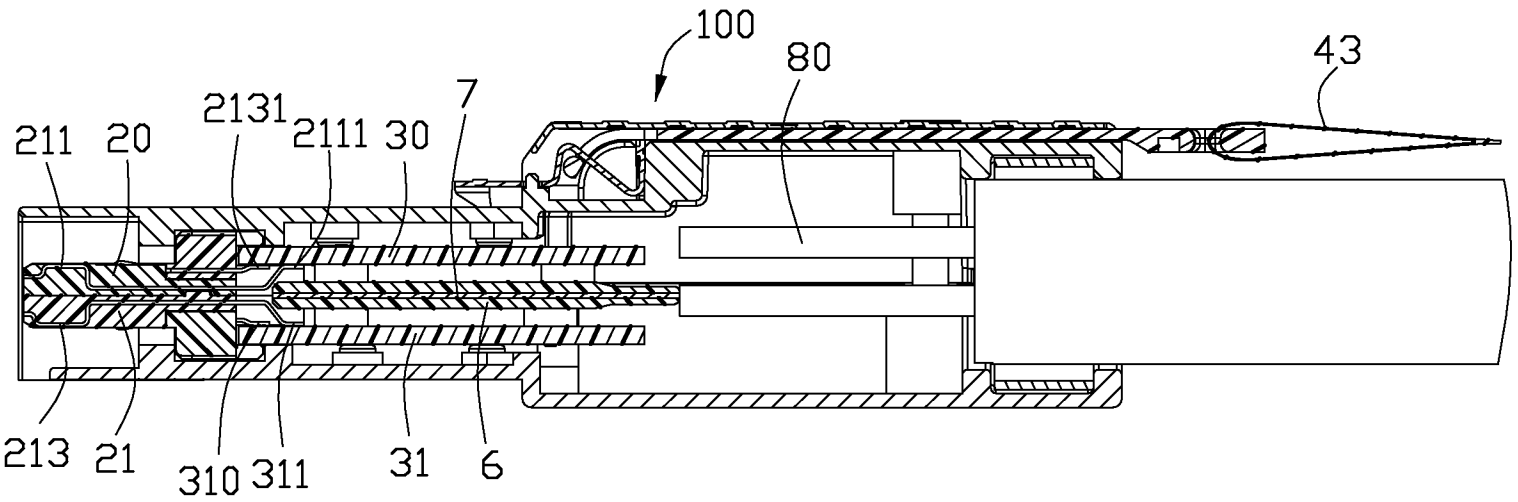
FIG. 8 is a cross section view of the cable assembly of FIG. 7 taken along line 8-8.

Referring to FIGS. 3 to 6 and in conjunction with FIG. 8, the terminal module 2 includes a first terminal unit 21 and a second terminal units 22 assembled with each other in a back-to-back manner. The first terminal unit 21 has a same structure with the second terminal unit 22. The first terminal unit 21 comprises a first insulative housing 210 and a plurality of first terminals 211 integrated formed therein, a first insulator 212 and a plurality of second terminals 213 integrated formed therein. The first insulative housing 210 defines a first tongue portion 2100 and a pair of side walls 2101. Each of the side wall 2101 defines a horizontal section 214 extending inwardly. The first insulator 212 defines two grooves 215 formed on a top surface thereof and disposed at two sides thereof for receiving the two horizontal sections 214. A pair of wedge-shaped projections 216 are respectively formed in the two grooves 215 for engaging with the two horizontal sections 214 of the first insulative housing 210. The first insulative housing 210 defines a plurality of receiving slots 2104 for receiving a plurality of second mating sections 2130 of the plurality of second terminals 213 and disposed in back of the plurality of first mating sections 2110 of the plurality of first terminals 211. Each of the first terminal 211 has a first terminating section 2111 extending rearwardly and beyond a rear surface of the first insulative housing 210. Each of the second terminal 213 has a second terminating section 2131 extending rearwardly and beyond a rear surface of the first insulative housing 210. The plurality of first terminating sections 2111 are located in front of the plurality of second terminating sections 2131. The first tongue portion 2100 defines a plurality of slits 2102 formed on a front surface thereof. The first tongue portion 2100 further defines a recess 2103 and a projection (not figured) formed on a bottom surface thereof.

Referring to FIGS. 3 to 6 and in conjunction with FIG. 8, the second terminal unit 22 has a same structure with the first terminal unit 21. The second terminal unit 22 has a projection 2201 and a recess (not figured) formed on a top surface 220 respectively cooperated with the recess 2103 and the projection formed on a bottom surface of the first terminal unit 21. The second terminal unit 22 also defines a plurality of slits 2102 formed on a front surface thereof. Each of two slits 2102 are in alignment with each other along a vertical direction for receiving a metallic clip 9.

Referring to FIGS. 1 to 6, the cable assembly 100 further defines a plurality of metallic clips 9 assembled to the terminal unit 2. Each of the metallic clip 9 is structured in a U-shape and defines a first arm 90 and a second arm 91 respectively received into the two slits 2102 formed on the first and second terminal units 2. The first and second arms 90, 91 respectively defines a plurality of barbs 900. Thus, the first and second arms 90, 91 are respectively firmly positioned in the two slits 2102 due to the barbs 900.

Referring to FIGS. 1 to 4 and in conjunction with FIG. 8, two printed circuit boards 3 comprises a first PCB 30 and a second PCB 31 paralleled with each other. The first PCB 30 defines a row of first conductive pads 300 and a row of second conductive pads 301 located in back of the first conductive pads 300. Two rows of the first and second conductive pads 300, 301 are formed on a bottom surface of the first PCB 30. The second PCB 31 also defines a row of first conductive pads 310 and a row of second conductive pads 311 located in back of the first conductive pads 310. Two rows of the first and second conductive pads 310, 311 are formed on a top surface of the second PCB 31. The row of first conductive pads 300 are electrically and mechanical connected to the second terminals 213 of the first terminal unit 21. The row of second conductive pads 301 are electrically and mechanically connected to the first terminals 213 of the first terminal unit 21. The second terminal unit 22 also defines a plurality of first and second terminals (not figured) electrically and mechanically connected to the second PCB 31. Two through holes 33 are respectively formed on the first and second PCBs 30, 31.

Figure 7:
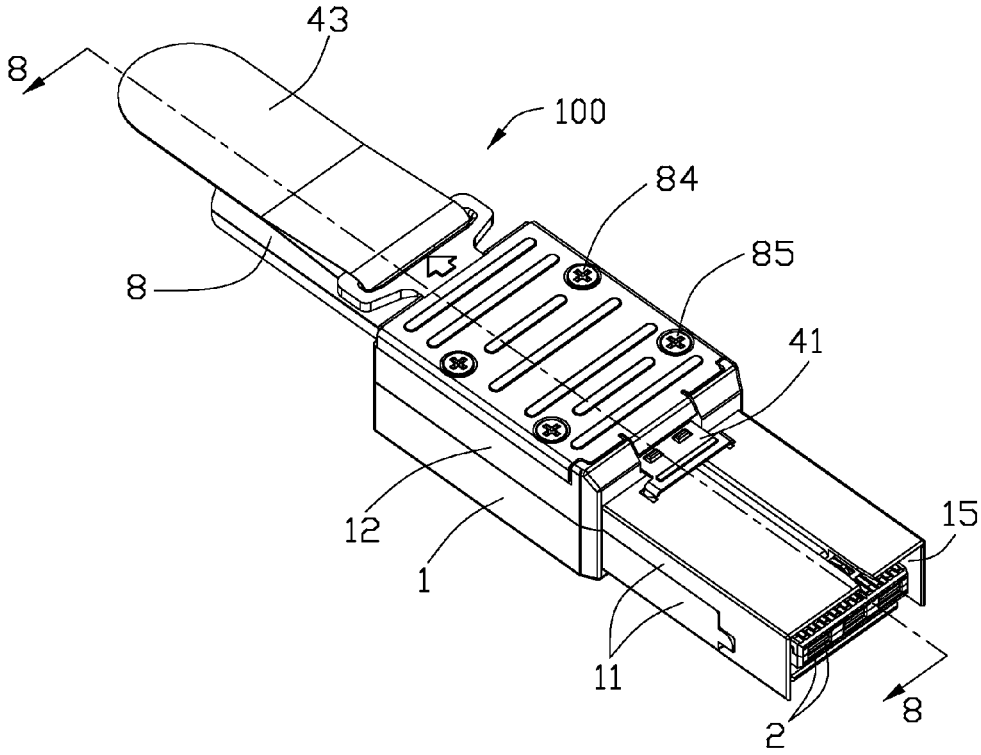
FIG. 7 is a perspective view of the cable assembly.

Referring to FIGS. 1 to 4 and in conjunction with FIGS. 7 to 8, the latch mechanism 4 is assembled to an exterior surface of the case 1 of the cable assembly 100. The latch mechanism 4 comprises a latching member 41, an actuating member 42 and a pulling tape 43 attached to the actuating member 42.

The actuating member 43 comprises a main portion 421 received into the first channel 1202, a pair of elastic portions 422 formed at two sides of the main portion 421 and received into the pair of first grooves 1205, a pair of tabs 423 formed at two sides of the main portion 421 and received into the pair of second grooves 1206 and an actuating portion 424 formed on a front end thereof and received into the second channel 1204.

The latching member 6 comprises latching section 411 located above the second mating section 12*b*, an engaging section 413 engaged with the second base section 12*a* and a N-shaped connecting section 412 connected the engaging section 413 to the latching section 411. The engaging section 413 defines two side segments 4131 received into the pair of slits 1207 to achieve an engagement between the latching member 6 and the case 1. The connecting section 412 defines a pair of rectangular holes 4110 cooperated with the pair of protrusions 1211 of the case 1.

A tape 43 is attached to a rear end of the actuating member 42. When a rearward pulling force exerts on the actuating member 42 or the tape 43, the front end of the actuating member 42 will actuate the latching member 41 and make the front end of the latching member 6 moving upwardly. When the pulling force is released, the front end of the latching member 41 will be resumed to an original state.

Referring to FIGS. 1 to 2, the metallic shell 5 is assembled to a top surface of the base portion of the case 1. Thus, a rear portion of the latching member 41 and a front portion of the actuating member 42 are shielded by the metallic shell 5. The metallic shell 5 comprises a top wall 50, a pair of side walls 51 extending downwardly form two lateral sides of the top wall 50 and a rear wall 52 extending downwardly from a rear side of the top wall 50. The metallic shell 5 further defines a front inclined wall 51. Four through holes 55, 56 are formed on the top wall 50 corresponding to the pair of first screw holes 1203 and the pair of second screw receiving holes 1208 along a vertical direction.

Referring to FIGS. 1 to 2 and in conjunction with FIG. 8, the spacer 6 defines four protruding sections 61 formed on top surface thereof and another four protruding sections 61 formed on a bottom surface thereof for supporting the first and second PCBs 30, 31.

Referring to FIGS. 1 to 2 and in conjunction with FIG. 8, the spacer 6 defines four protruding sections 61 formed on top surface thereof and another four protruding sections 61 formed on a bottom surface thereof for supporting the first and second PCBs 30, 31. A grounding plate 7 is integrated formed in the spacer 6. The grounding plate 7 defines a main section 71 disposed in the spacer 6 and four sticks 72 extending out of the spacer 6 and respectively inserted into the first and second PCBs 30, 31. The main section 71 of the grounding plate 7 defines a front end 73. The four sticks 72 extend out of the spacer 6 through four slits 611, 612. The four sticks 72 are perpendicular to the main section 71.

Referring to FIGS. 1 to 4, a cable 8 is terminated to the first and second PCBs 30, 31. The cable 8 comprises a plurality of conductive wires 80 and an insulative jacket 81 surrounding the plurality of conductors 51. The cable 8 further comprises an inner ring 83 surrounding the insulative jacket 81 and an outer ring 82 surrounding the inner ring 83.

Referring to FIGS. 1 to 8, the assembling process of the cable assembly 100 made in according to the present invention starts from assembling the first insulator 212 to the first insulative housing 210 to form the first terminal unit 21. The second terminal unit 22 is also formed through the above assembling steps. Thus, the terminal module 2 is formed by the first and second terminal units 21, 22 assembled with each other in a back-to-back manner. The mating sections 2110, 2130 of the first and second terminals 211, 213 are formed on a top and bottom surfaces of the terminal module 2. The mating sections 2110 of the first terminals 211 are arranged along a transversal direction and disposed in front of the mating sections 2113 of the second terminals 213. Then, a plurality of metallic clip 9 are assembled to a front end of the terminal module 2.

After the terminal module 2 is formed, then assembling the first and second PCBs 30, 31 respectively to the two sides of the spacer 6. The sticks 72 of the grounding plate 7 of the spacer 6 are received into the first and second PCBs 30, 31. Thus, the first and second PCBs 30, 31 and the spacer 6 are assembled together.

After the first and second PCBs 30, 31 are assembled to the spacer 6, then assembling the first and second PCBs 30, 31 to a rear end of the terminal module 2. It should be noted that the terminating sections 2111 of the first terminals 211 of the first terminal unit 21 are soldered to the second conductive pads 301 of the first PCB 30. And, the terminating sections 2113 of the second terminals 213 of the first terminal unit 21 are soldered to the first conductive pads 300 of the first PCB 30. And, the second terminal unit 22 is soldered to the second PCB 31 according to the same assembling steps between the first terminal unit 21 and the first PCB 30.

After the terminal module 2 is assembled to the first and second PCBs 30, 31, then assembling the cable 8 to the first and second PCBs 30, 31. A plurality of conductive wires 80 are electrically connected to the two rear ends of the first and second PCBs 30, 31.

After the cable 8 is assembled to the first and second PCBs 30, 31, then assembling the terminal module 2, the two PCBs 30, 31 and the cable 8 together to the first shield part 11. Then, the second shield part 12 is assembled to the second shield part 12. The terminal module 2, the two PCBs 30, 31 are received into the case 1. And the cable 8 extends rearwardly and out of the case 1.

Then, assembling the latch mechanism 4 to an exterior surface of the case 1. The actuating member 42 is interconnected with the latching member 41. The tape 43 is connected to a rear end of the actuating member 42. The actuating section 424 of the actuating member 42 is interconnected with the latching member 41. A portion of the actuating section 424 of the actuating member 42 is located below the connecting section 412 latching member 41. The latching member 41 will be raised up by an upwardly movement of the actuating section 412 of the actuating member 42 when the actuating member 42 is moved rearwardly.

Then, assembling the metallic shell 5 to the top surface of the base portion of the case 1 to shield a portion of the latch mechanism 4.

Finally, assembling a plurality of first screws 84 passing through the metallic shell 5, the second shield part 12 and received into the first shield part 11 along an up to down direction. And, a plurality of second screws 85 are passed through the metallic shell 5 and received into the second shield part 12. Thus, the metallic shell 5, the first shield part 11 and second shield part 12 are engaged together by the first and second screws 84, 85.

After the above assembling steps, the entire process of assembling of the cable assembly 100 is finished. The cable assembly 100 has a new mating interface with a high speed signal transmitting. And, the new interface of the cable assembly 100 is smaller and lower.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

a case having a receiving room;

a pair of printed circuit boards received into the receiving room, the pair of printed circuit boards spaced apart and paralleled with each other along an up-to-down direction;

a cable extending into the receiving room and electrically connected with two rear ends of the two printed circuit board;

a terminal module disposed in the receiving room and electrically connected with two front ends of the two printed circuit boards, the terminal module defining two sets of first terminals and two sets of second terminals formed therein, the first and second terminals defining a first and second mating sections, respectively, formed on a respective front end thereof, the first mating sections of the two sets of first terminals respectively formed on a top and bottom surface of the terminal module, the second mating sections of the two sets of second terminals respectively formed on the top and bottom surfaces of the terminal module, the first mating sections located in front of the second mating sections;

wherein the cable assembly further comprises a spacer sandwiched by the pair of printed circuit boards and having a grounding plate formed therein, the grounding plate has a plurality of sticks respectively extending into the pair of printed circuit boards.

2. The cable assembly as recited in claim 1, wherein the terminal module comprises a first terminal unit and second terminal unit assembled together in a back-to-back manner.

3. The cable assembly as recited in claim 2, wherein a set of first terminals and a set of second terminals are integrated formed in the first terminal unit, a set of first terminals and a set of second terminals are integrated formed in the second terminal unit.

4. The cable assembly as recited in claim 3, wherein the first terminal unit defines a first insulative housing and a first insulator assembled to the first insulative housing, a set of first terminals are integrated formed in the first insulative housing, a set of second terminals are integrated formed in the first insulator, the second terminal unit defines a second insulative housing and a second insulator assembled to the second insulative housing, a set of first terminals are integrated formed in the second insulative housing, a set of second terminals are integrated formed in the second insulator.

5. The cable assembly as recited in claim 1, wherein the cable assembly further comprises a latch mechanism assembled to an exterior surface of the case and a metallic shell assembled to a portion of the case to shield a portion of the latch mechanism.

6. The cable assembly as recited in claim 1, wherein the cable assembly further defines a plurality of metallic clips assembled to a front end of the terminal module.

7. The cable assembly as recited in claim 1, wherein each of the first mating section is flat, each of the second mating section is resilient.

8. A cable assembly, comprising:

a metallic case having a receiving room;

a terminal module disposed in the receiving room and comprising a first terminal unit and a second terminal units assembled with each other in a back-to-back manner;

a plurality of metallic clips assembled to a front end of the terminal module to engage the first and second terminal units together along an up-to-down direction; and a cable extended into the receiving room and electrically connected with the terminal module.

9. The cable assembly as recited in claim 8, wherein the cable assembly further comprises two paralleled printed circuit boards disposed between the terminal module and the cable and respectively electrically connected to the terminal module and the cable.

10. The cable assembly as recited in claim 9, wherein the cable assembly further comprises a spacer sandwiched by the pair of printed circuit boards and having a grounding plate formed therein, the grounding plate has a plurality of sticks extending out of the spacer and inserted into the pair of printed circuit boards.

11. The cable assembly as recited in claim 8, wherein the terminal module has two sets of first terminals and two sets of second terminals formed therein, a set of first and second terminals respectively defines a plurality of mating sections extending to a top surface of the terminal module, another set of first and second terminals respectively defines a plurality of mating sections extending to a bottom surface of the terminal module.

12. The cable assembly as recited in claim 8, wherein each of the metallic clip is structured in a U-shape.

13. A cable connector assembly comprising:

a pair of first and second modules stacked together and commonly defining mating two opposite outward first and second faces in a vertical direction;

a plurality of immoveable contacts divided into first and second groups respectively associated with the corresponding first and second modules with immoveable contacting sections exposed upon the first and second faces respectively;

a plurality of moveable contacts divided into first and second sets respectively associated with the corresponding first and second modules with moveable contacting sections exposed upon the first and second faces, respectively; and one set of printed circuit board located behind the modules; wherein tails of both the moveable contacts and the immoveable contacts are mounted a front portion of the set of printed circuit board.

14. The cable connector assembly as claimed in claim 13, wherein the immoveable contacting sections are located in front of the moveable contacting sections.

15. The cable connector assembly as claimed in claim 14, wherein said set of printed circuit board includes opposite first and second sub-printed circuit boards spaced from each other in the vertical direction, and the tails of the first group moveable contacts and of the first set immoveable contacts are connected to the first sub-printed circuit board, and the tails of the second group moveable contacts and of the second set immoveable contacts are connected to the second sub-printed circuit board.

16. The cable connector assembly as claimed in claim 15, wherein the first and second sub-printed circuit boards define interior faces facing to each other, and the tails of the moveable contacts and the immoveable contacts are mounted thereon.

17. The cable connector assembly as claimed in claim 15, wherein an insulative spacer with a grounding plate therein, is located between the first and second sub-printed circuit boards.

18. The cable connector assembly as claimed in claim 13, wherein a plurality metallic clips assembles front ends of the first and second modules together.

19. The cable connector assembly as claimed in claim 13, wherein the first set moveable contacts are integrally formed within a first insulator and the first insulator is attached to a first insulative housing of the first module in which the first group immoveable contacts are embedded; the second set moveable contacts are integrally formed within a second insulator and the second insulator is attached to a second insulative housing of the second module in which the second group immoveable contacts are embedded.

* * * * *